US009169627B2

(12) United States Patent
Daniels et al.

(10) Patent No.: US 9,169,627 B2
(45) Date of Patent: Oct. 27, 2015

(54) DECORATIVE FLUSH LEVER

(75) Inventors: James Leroy Daniels, Stokesdale, NC (US); William Spencer, Burlington, NC (US)

(73) Assignee: Liberty Hardware Mfg. Corp., Winston-Salem, NC (US)

( * ) Notice: Subject to any disclaimer, the term of this patent is extended or adjusted under 35 U.S.C. 154(b) by 404 days.

(21) Appl. No.: 13/206,772

(22) Filed: Aug. 10, 2011

(65) Prior Publication Data

US 2012/0036625 A1 Feb. 16, 2012

Related U.S. Application Data

(60) Provisional application No. 61/374,023, filed on Aug. 16, 2010.

(51) Int. Cl.
*E03D 5/00* (2006.01)
*E03D 5/092* (2006.01)

(52) U.S. Cl.
CPC ..... *E03D 5/092* (2013.01); *Y10T 29/49826* (2015.01)

(58) Field of Classification Search
CPC ..... E03D 5/092; E03D 5/09; E03D 5/094
USPC ..... 4/405
See application file for complete search history.

(56) References Cited

U.S. PATENT DOCUMENTS

| | | | | |
|---|---|---|---|---|
| 977,937 | A * | 12/1910 | Crane | 4/410 |
| 1,423,888 | A * | 7/1922 | Theleen | 4/405 |
| 1,531,359 | A * | 3/1925 | Tilden | 4/405 |
| 1,575,236 | A * | 3/1926 | Tilden | 4/405 |
| 1,583,325 | A * | 5/1926 | Tilden | 4/405 |
| 2,229,459 | A * | 1/1941 | Koerner | 74/548 |
| 2,248,126 | A * | 7/1941 | Schafer | 4/405 |
| 2,469,000 | A * | 5/1949 | Pleasant | 4/413 |
| 6,378,790 | B1 | 4/2002 | Paterson et al. | |
| 6,453,480 | B1 * | 9/2002 | Yeh | 4/405 |
| 6,637,044 | B2 * | 10/2003 | Rische et al. | 4/405 |
| 7,596,819 | B2 * | 10/2009 | Dutton et al. | 4/405 |
| 2003/0150053 | A1 * | 8/2003 | Rische et al. | 4/405 |
| 2005/0273919 | A1 | 12/2005 | Berlovan | |
| 2007/0240256 | A1 * | 10/2007 | Tau et al. | 4/405 |
| 2008/0115263 | A1 * | 5/2008 | Siena et al. | 4/405 |

* cited by examiner

*Primary Examiner* — Janie Christiansen
(74) *Attorney, Agent, or Firm* — Carlson, Gaskey & Olds, PC

(57) ABSTRACT

A toilet lever system includes a body for extending through a toilet wall, a stem extending through the body for movement relative to the body, a decorative flange covering the stem and removeably attaching to the body, and a handle attaching to the stem.

34 Claims, 2 Drawing Sheets

DECORATIVE FLUSH LEVER

RELATED APPLICATION

This application claims priority to U.S. Provisional Application No. 61/374,023, which was filed Aug. 16, 2010.

BACKGROUND

Toilet levers are well known. Typically, a lever, which is manipulated by the user, rotates a spindle that rotates a lever to activate a toilet valve.

Some toilet levers become noisy and hard to use over time.

SUMMARY

According to an exemplar herein, a toilet lever system includes a hollow body for extending through a toilet wall, a stem extending through the hollow body for movement relative to the body, a decorative flange covering the stem and removably attaching to the body, and a handle attaching to the stem.

According to a further exemplar herein, a kit has a hollow body for extending through a toilet wall, the hollow body having an end flange greater than an opening of a hole in the toilet wall, a stem extending through the hollow body for movement relative to the body, a plurality of flanges for covering a length of the stem and removably attaching to the hollow body the flange having first decorative features, a plurality of portions for covering an end of the stem and removably attaching to the stem, the portion having decorative features and a plurality handles for attaching to the portion the handle having decorative features.

According to a still further exemplar herein, a method for assembling a toilet flush system includes providing a body for extending through a toilet wall, providing a stem extending through the body for movement relative to the body, providing more than one flanges for covering the stem, the more than one flanges removably attaching to the body the more than one flanges having decorative features, and providing more than one handles for rotating the stem, the more than one handle having decorative features. Once provide the method further includes selecting one of the more than one flange, selecting one of the more than one handle, and attaching the selected one of the more than one flange to the body, and attaching the selected one of more than one handle to the stem.

These and other features of the present invention can be best understood from the following specification and drawings, the following of which is a brief description.

DETAILED DESCRIPTION

Figure 1:
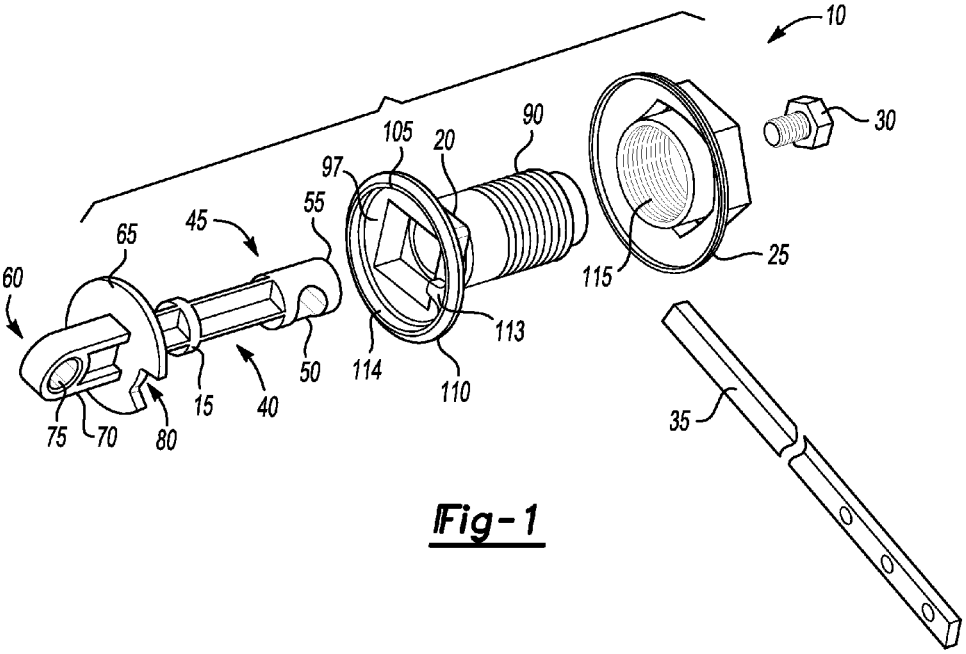
FIG. 1 is an exploded view of the toilet lever system of the invention.
Figure 2:
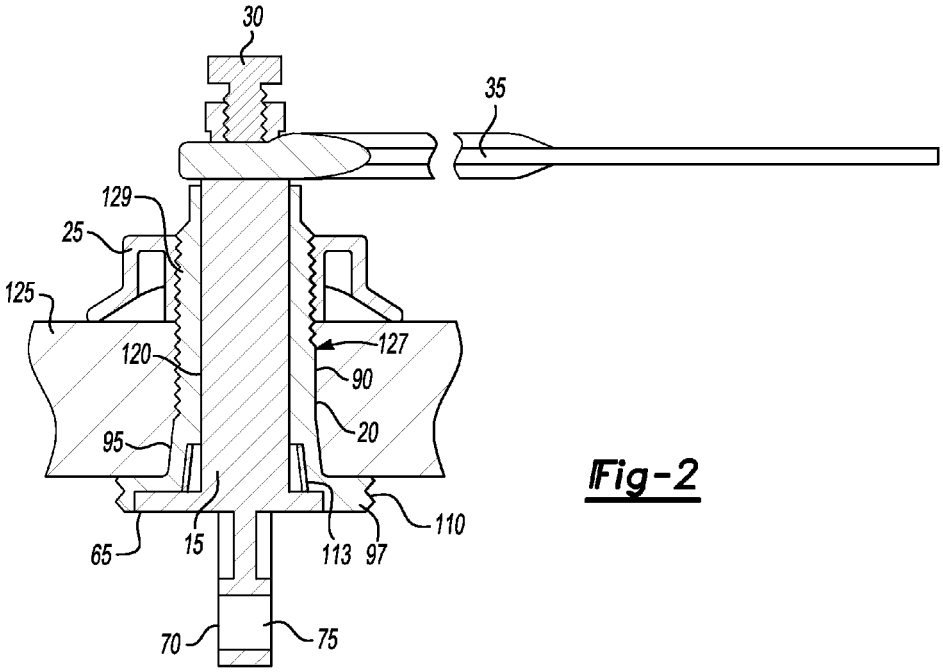
FIG. 2 is a cross sectional view of the toilet lever of FIG. 1.

Referring now to FIGS. 1 and 2, the toilet lever system 10 of the invention includes a stem 15, a main body 20, a flange nut 25, a bolt 30 and a lever arm 35.

The stem 15 includes a column 40 that may have material removed to make the part lighter. A first end 45 of the stem includes a first transverse opening 50 to receive the lever arm 35 and an axial opening 55 to receive the bolt 30, and a second end 60 of the stem includes a circular platform 65 and an extension 70. The extension 70 has a rectangular cross section and a second transverse opening 75. The platform 65 has a detent 80 that may be wedge shaped that helps limit the travel of the column 40, and therefore the lever arm 35, if the column 40 is rotated by manipulating the handle 85 (See FIGS. 3 and 4).

Figure 3:
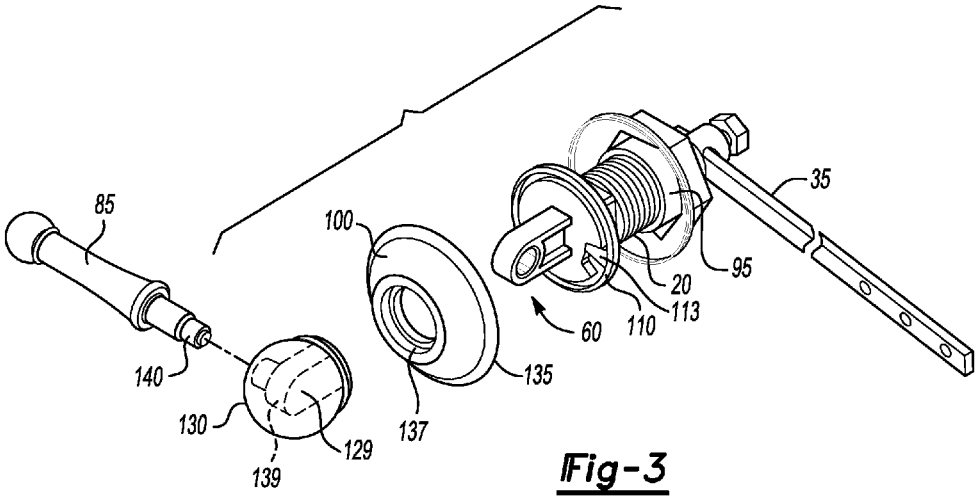
FIG. 3 is a second exploded view of the toilet lever system of FIG. 1.
Figure 4:
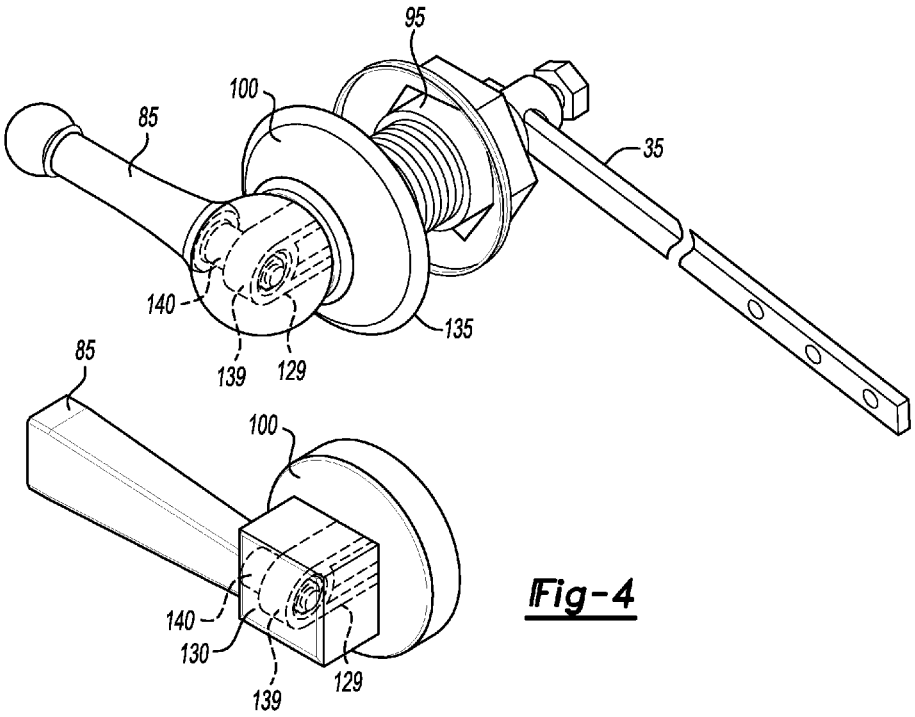
FIG. 4 is an assembled version of the toilet lever system of FIG. 3 showing differing decorative features.

The main body 20 has a hollow threaded body 90, a nut shape 95 disposed on the body 90 coaxially therewith, and an end flange 97 for receiving a flange cover 100 as will be shown in FIGS. 3 and 4. The end flange 97 has a cylindrical extension 105 in which the circular platform 65 is received and an outer threaded portion 110 for attaching to a flange 100 which acts as a decorative cover (see FIGS. 3 and 4). The circular portion 90 of the main body 20 is hollow for receiving the stem 15 therethrough. The circular portion 90 of the main body is designed to fit an opening 127 within a toilet wall 125 and may be any shape that is required to fit the opening in a toilet for the system. The circular portion 90 has a threaded portion 129. A pawl 113 is disposed on an inner surface 114 of the depression 105 and extends axially inwardly. As will be discussed herein, the pawl 113 cooperates with the detent 80

The flange nut 25 has an interior threaded surface 115, which mates with threaded portion 129 of the threaded body 90. The flange nut 25 has a wider diameter than the threaded body 90 so that a toilet tank wall can be securely enclosed between the end flange 97 and the flange nut 25.

In practice, the nut shape 95 is placed into an opening 127 of the toilet wall 125 (see FIG. 2) so that the main body 20 fits securely therein. The flange nut 25 is screwed onto the threaded body 90, the stem column 40 is placed through the threaded body such that the stem extends beyond the flange nut far enough to allow the lever arm 35 to extend through the first transverse opening 50 and be secured therein by securing the bolt 30 in the axial opening 55. The lever arm 35, as is known in the art, has a rectangular cross-section that attaches to a flush valve (not shown). By torquing the bolt 30 securely in the axial opening 55 in front of a toilet (not shown), the lever arm 35 is securely held within the main body 20. The circular platform 65 is placed within the depression 105 with the pawl 113 disposed in the detent 80. Rotation of the stem 15 is limited by travel of the pawl 113 within the detent 80 to avoid over-rotation of the lever arm 35.

Referring now to FIGS. 3 and 4, a flange cover 100, a stem cap 130, and a handle 85 are shown. The flange cover 100 has an interior threaded surface 135 mating with the outer threaded surface 110 of the cylindrical extension 97 of the main body 20. The second end 60 of the stem 15 extends through opening 137 the flange cover 100. The stem cap 130 has an axial hole 129 that mates with the second end 60 of stem 15. The stem cap 130 also has a lateral hole 139 that matches the second transverse opening 75 in the stem 15 and receives a threaded shaft 140 of the handle 85 therein. The threaded shaft 140 in the handle screws into the second transverse opening 75 of the stem thereby securing the handle to the stem cap 130 for motion independent of the flange cover 100. The stem cap 130 is also then securely held in the opening 137 of the flange cover 100. By making it easy to attach the handle to the stem and the flange cover to the main body 20, a user may be more able to coordinate decoratively any toilet hardware, such as the flange cover, with other hardware, such as toilet paper holders, towel hangers, faucets or mirrors or the like in a bathroom. A manufacturer of the toilet lever system 10 herein may choose to include more than one handle 85, one stem cap 130 and one flange cover 100 having different decorative styles in a package (not shown) to enable a user to decorate a bathroom more easily by choosing one style of the other or some combination thereof (see FIG. 4).

A user may also find it much easier to modify the décor of a bathroom by simply replacing the flange cover 100, the stem cap 130 or the handle 85 without having to remove the body 20, the flange nut 25, or the stem 15.

A box (not shown) that holds a kit including the items noted above also includes a plurality of handles 85 having each having different decorative features, a plurality of flange covers 100 having each having different decorative features and a plurality of end caps 130 having each having different decorative features. A user is then free to choose which decorative look is appropriate for each application. The different decorative features may be mixed or matched at the user's wish.

Although embodiments of this invention have been disclosed, a worker of ordinary skill in this art would recognize that certain modifications would come within the scope of this invention. For that reason, the following claims should be studied to determine the true scope and content of this invention.

What is claimed is:

1. A toilet lever system comprising:

a hollow body to extend through an opening in a toilet wall having an external surface and an internal surface, said hollow body having a first end configured to extend beyond said external surface and a second end configured to extend beyond said internal surface, and wherein said hollow body includes an end flange at said first end that has a diameter that is greater than the opening in the toilet wall, a stem extending entirely through said hollow body from said first end to said second end for movement relative to said body, and wherein said stem extends along an axis from a first stem end extending beyond the external surface to a second stem end that extends beyond the internal surface, a flange nut attached to said hollow body at said second end and configured to clamp the toilet wall between said flange nut and said end flange, a decorative flange covering said stem and removably attaching to said body, and a handle attaching to said stem wherein said first stem end includes a first opening that is transverse to said axis and which receives an end of said handle, and said second stem end includes a second opening transverse to said axis and which receives a lever arm.

2. The toilet lever system of claim 1 including a decorative portion having a first decorative portion opening that is aligned with said axis and in which said first stem end is received, said decorative portion being separate from said decorative flange and separate from said handle.

3. The toilet lever system of claim 2 wherein said decorative portion has a second decorative portion opening transverse to and intersecting said first decorative portion opening for receiving said handle.

4. The toilet lever system of claim 2 wherein said first decorative portion opening has a shape that matches a shape of said first stem end.

5. The toilet lever system of claim 1 wherein said decorative portion rotates relative to said decorative flange if said handle is manipulated.

6. The toilet lever system of claim 1 wherein said flange nut is configured to secure said hollow body in said opening when said flange nut is screwed onto said hollow body on the internal side of the toilet wall remote from said end flange, and wherein said flange nut is configured to abut directly against the internal surface of the toilet wall and wherein one side of said end flange is configured to abut directly against the external surface of said toilet wall.

7. The toilet lever system of claim 6 wherein said stem has a detent and said end flange has a pawl that is disposed in said detent wherein said detent limits travel of said stem if said stem is rotated by said handle.

8. The toilet lever system of claim 6 wherein said decorative flange removably and directly attaches to said end flange adjacent said external surface of said toilet wall.

9. The toilet lever system of claim 8 wherein said end flange has a threaded outer surface and said decorative flange includes an inner threaded surface that threadably attaches to said threaded outer surface.

10. The system of claim 1 wherein said end flange is configured to project beyond said external surface, said end flange having a threaded outer surface about a periphery of said end flange, and wherein said decorative flange has an internal threaded surface that is removably attached to said threaded outer surface of said end flange.

11. The system of claim 10 wherein said stem includes a platform located between said first and second stem ends, and wherein said end flange includes a depression that receives said platform such that said first stem end projects beyond said platform to connect to said handle.

12. The toilet lever system of claim 1 wherein one end of said stem has a circular cross-section and an opposite end of said stem has a rectangular cross-section.

13. The toilet lever system of claim 12 wherein said stem includes a platform that separates the circular cross-section from the rectangular cross-section.

14. The toilet lever system of claim 1 wherein said second stem end includes a third opening extending along said axis, and wherein said lever arm has a solid lever arm that is inserted through said second opening and is clamped therein by a fastener that is inserted through said third opening to abut against said solid lever arm.

15. The toilet lever system of claim 1 wherein said hollow body includes a nut-shaped portion positioned between said end flange and a threaded hollow body portion, said nut-shaped portion configured to be received within the opening in the toilet wall.

16. The toilet lever system of claim 1 wherein said first opening of said first stem end is spaced outwardly of said external surface.

17. The toilet lever system of claim 1 wherein said stem includes a platform defining an outermost peripheral surface of said stem, said platform abutting against said end flange.

18. The toilet lever system of claim 17 wherein the platform includes a travel limiter to limit rotation of said stem.

19. The toilet lever system of claim 18 wherein one of said platform and said end flange includes a pawl and the other of said platform and end flange includes a detent, said pawl and said detent cooperating with each other to define said travel limiter.

20. A kit, said kit comprising:

a hollow body configured to extend through a toilet wall having an internal surface and an external surface, said hollow body having an end flange to be located adjacent said external wall, said end flange being greater in size than an opening of a hole in said toilet wall, a stem defining an axis extending from a first stem end that extends beyond the external surface to a second stem end that extends beyond the internal surface, and said stem extending through said hollow body for movement relative to said body, said first stem end including a first opening that extends transverse to said axis with said first opening to be positioned outward of an external side of the toilet wall, and wherein said second stem end includes a second opening transverse to said axis and which receives a lever arm, a plurality of flanges for covering an outer portion of said stem that would project outwardly from the external surface, wherein each flange is configured to be removably attached to said hollow body, said plurality of flanges having first decorative features, a plurality of portions for covering said first end of said stem that projects outwardly of the external surface, wherein each portion is configured to be removably attached to said stem, said plurality of portions having second decorative features, and a plurality handles for attaching directly to said stem through said first opening to define an attachment interface, a selected one of said plurality of portions covering the attachment interface and being separately attached to a selected one of said plurality of handles, said handle having third decorative features.

21. The kit of claim 20 wherein:

each of said plurality of portions has a first decorative portion opening in which the first stem end is received.

22. The kit of claim 21 wherein each of said plurality of portions has a second decorative portion opening transverse to and intersecting said first decorative portion opening for receiving the selected one of said plurality of handles.

23. The kit of claim 21 wherein said first decorative portion opening of said plurality of portions has a shape that matches with a shape of said first stem end.

24. The kit of claim 20 wherein said portion rotates relative to said flange if said handle is manipulated, and wherein said stem includes a platform defining an outermost peripheral surface of said stem, said platform abutting against said end flange of said hollow body, and wherein said platform includes a travel limiter to limit rotation of said stem.

25. The kit of claim 24 wherein one of said platform and said end flange includes a pawl and the other of said platform and end flange includes a detent, said pawl and said detent cooperating with each other to define said travel limiter.

26. The kit of claim 20 further including a nut to secure said hollow body in said opening if said nut is screwed onto said hollow body on the internal side of the toilet wall remote from said end flange, and wherein said flange nut is directly attached to said hollow body and is configured to clamp the toilet wall between said flange nut and said end flange, and wherein said flange nut is configured to abut directly against the internal surface of the toilet wall and wherein one side of said end flange is configured to abut directly against the external surface of said toilet wall.

27. The kit of claim 26 wherein said stem has a detent and said end flange has a pawl that is disposed in said detent, and wherein said detent limits travel of said stem if said stem is rotated by said handle.

28. The kit of claim 20 wherein said end flange is configured to project beyond said external surface, and wherein said one of said plurality of flanges is removably and directly attached to said end flange of said hollow body.

29. The kit of claim 28 wherein said stem includes a platform located between said first and second stem ends, and wherein said end flange includes a depression that receives said platform such that said first stem end projects beyond said platform to connect to said handle, and wherein said platform includes a travel limiter to limit rotation of said stem.

30. A method for assembling a toilet flush system comprising;

providing a body for extending through a toilet wall having an internal surface and an external surface, providing a stem extending entirely through said body from the internal surface to the external surface for movement relative to said body, wherein said stem extends along an axis from a first stem end extending beyond the external surface to a second stem end that extends beyond the internal surface, and wherein said first stem end includes a first opening that is transverse to said axis and said second stem end includes a second opening transverse to said axis and which receives a lever arm, providing more than one flange for covering said stem, said more than one flange removably and directly attaching to said body on an external side of the toilet wall, said more than one flange having decorative features, providing more than one handle for rotating said stem, said more than one handle having decorative features, selecting one of said more than one flange, selecting one of said more than one handle, attaching said selected one of said more than one flange to said body, and attaching said selected one of more than one handle to said stem through said first opening.

31. The method of claim 30 further comprising:

providing more than one portion for attaching to said stem, said more than one portion having decorative features, selecting one of said more than one portion, and attaching said selected one of said more than one portion to said body.

32. The method of claim 30 further comprising:

selecting said one of said more than one flange and said one of said more than one handle based on whether said decorative features of said more than one flange and said one of said more than one handle coordinate.

33. The method of claim 30 wherein said body comprises a hollow body having a first end that includes an end flange to project beyond said external surface, said more than one flange configured for removable attachment to said end flange, and wherein said first opening of said first stem end is spaced outwardly of said end flange.

34. The method of claim 33 wherein the stem includes a platform defining an outermost peripheral surface of said stem, and wherein said end flange includes a depression that receives said platform, wherein one of said platform and said end flange includes a pawl and the other of said platform and end flange includes a detent, said pawl and said detent cooperating with each other to define a travel limiter that limits rotation of said stem.

* * * * *